United States Patent [19]

Ellison

[11] 4,311,094

[45] Jan. 19, 1982

[54] METHOD AND APPARATUS FOR REMOVING FOREIGN MATTER FROM A PRINTING PRESS PLATE CYLINDER

[76] Inventor: Lloyd W. Ellison, P.O. Box 126, Jupiter, Fla. 33458

[21] Appl. No.: 19,336

[22] Filed: Mar. 12, 1979

[51] Int. Cl.[3] ..... B41F 35/00; B41L 41/00

[52] U.S. Cl. ..... 101/425; 101/155; 101/169

[58] Field of Search ..... 101/423–425, 101/167–169, 157, 155, 156, 161, 154; 15/256.52

[56] References Cited

U.S. PATENT DOCUMENTS

| | | | |
|---|---|---|---|
| 2,054,618 | 9/1936 | Ford | 101/425 |
| 2,117,958 | 5/1938 | Hershey | 101/425 |
| 2,847,935 | 8/1958 | Richter | 101/425 |
| 2,898,855 | 8/1959 | Richter | 101/425 |
| 2,961,953 | 11/1960 | Mosegaard | 101/425 |
| 2,969,735 | 1/1961 | Cope | 101/425 |
| 2,970,541 | 2/1961 | Gegenheimer | 101/425 |
| 3,016,826 | 1/1962 | Sage | 101/425 |
| 3,108,539 | 10/1961 | Champion | 101/425 |
| 3,144,826 | 8/1964 | Lang | 101/425 |
| 3,194,156 | 7/1965 | Picking | 101/425 |
| 3,252,416 | 5/1966 | Allen | 101/425 |
| 3,309,993 | 3/1967 | Grembecki | 101/425 |
| 3,312,166 | 4/1967 | Gentile | 101/148 |
| 3,601,051 | 8/1971 | Gegenheimer | 101/425 |
| 3,656,431 | 4/1972 | Giori | 101/425 |
| 3,822,642 | 7/1974 | Grindeland | 101/425 |
| 3,835,779 | 9/1974 | Ross | 101/425 |
| 4,082,038 | 4/1978 | Veno | 101/425 |

*Primary Examiner*—Steven A. Bratlie
*Assistant Examiner*—A. Heinz
*Attorney, Agent, or Firm*—Schuyler, Banner, Birch, McKie & Beckett

[57] ABSTRACT

An apparatus is provided for removing particles of foreign matter adhering to the surface of a printing plate mounted on a rotating plate cylinder. The apparatus comprises a pair of parallel, spaced flexible blades which contact the surface of the printing plate. One blade spreads and thins the layer of ink on the surface to expose the adhering particles, and the other blade disturbs and dislodges them from the surface. A method for removing particles in this manner is also provided.

11 Claims, 5 Drawing Figures

METHOD AND APPARATUS FOR REMOVING FOREIGN MATTER FROM A PRINTING PRESS PLATE CYLINDER

BACKGROUND OF THE INVENTION

1. Field of the Invention

The present invention relates generally to cleaning devices for printing presses and, more particularly, to a method and apparatus for removing foreign matter adhering to the surface of a printing plate mounted on a rotating plate cylinder.

2. Description of the Prior Art

Planographic printing presses typically incorporate an image-bearing printing plate which is mounted on a rotating plate cylinder. Ink is applied to the image-bearing portion of the printing plate and the ink is then transferred by suitable means to the paper on which the image is printed. Lithographic and offset printing presses operate in this manner.

A serious problem which has plagued the printing industry concerning printing presses of this type is the adherence of dirt and other particles of foreign matter to the surface of the printing plate. Such foreign matter may comprise, for example, airborne dust, agglomerated ink solids and paper fluff. Once these particles adhere to the surface of the printing plate they are covered with ink in the next inking operation and form a spot or other imperfection which is transferred to the printed sheet. Hence, these particles interfere with the faithful reproduction of the image borne by the printing plate.

These particles are known in the trade as "hickeys." Their occurrence not only increases the cost of printing, but also poses a safety threat to press operators. In this regard, to shut down a printing press to remove the hickeys is a very costly proposition. However, an unacceptable print job is even more costly. A well known method of removing hickeys is the "thumb" method. This involves an attempt by the press operator to "flick" the hickey off the surface of the printing plate while it is moving at high speed. Of course, this method is very dangerous and completely impractical and, unfortunately, has resulted in the loss of numerous thumbs.

Devices have been developed which purport to safely and effectively remove particles of foreign matter from the surface of printing plates. These include arrangements for movably supporting a scraping blade in close proximity to the rotating plate cylinder. When a defect in the finished product is noticed, the scraper is moved into contact with the surface of the printing plate to attempt to dislodge the adhering particles. Some of these devices incorporate narrow scrapers which must be moved to a position along the width of the plate cylinder which corresponds to the location of the defect, and hopefully the location of the foreign particles. Operation of a device of this type is a hit-and-miss proposition. Other devices incorporate elongated scrapers which contact the entire width of the printing plate when actuated. Another device which has been developed to remove these particles comprises a rubber or leather roller having an irregular surface in constant rolling contact with the plate cylinder. While these may be effective to remove particles for a short period of time, they must be periodically removed from the press and cleaned by hand, resulting in significant press down time of up to a full day for each cleaning.

These prior art devices are relatively costly to manufacture and incorporate into existing printing presses. They are either too abrasive to the printing plate or too soft to have any meaningful service life. Most importantly, they have not proven to be effective solutions to the hickey problem. Hence, very few printing presses in use today incorporate plate cleaning devices at all, resulting in the common but dangerous use of the "thumb method."

SUMMARY OF THE INVENTION

Accordingly, it is an object of the present invention to obviate the above-noted shortcomings and disadvantages of the prior art by providing a method and apparatus for removing particles of foreign matter adhering to the surface of a printing plate mounted on a rotating plate cylinder which is inexpensive to implement and effective to completely remove the adhering particles.

Another object of the invention is to provide such an apparatus which can be readily adapted to existing printing presses with a minimum of modification.

A further object of the invention is to provide such an apparatus which will not harm the surface of the printing plate despite its long-wearing characteristics.

Another object of the invention is to provide such an apparatus which will prevent the spread of residue removed from the surface of the printing plate.

These and other objects of the present invention are accomplished by providing an apparatus for removing particles of foreign matter adhering to the surface of a printing plate mounted on a rotating plate cylinder of a rotary printing press, the apparatus comprising a movable support mounted adjacent to the plate cylinder and the surface of the printing plate, wiping means carried by the support for wiping the surface of the printing plate to spread and thin the layer of ink on the surface and expose the particles, sweeping means carried by the support for sweeping the surface wiped by the wiping means to disturb and dislodge the exposed particles, and operating means connected to the support for selectively moving the wiping means and the sweeping means into and out of contact with the surface of the printing plate during rotation of the plate cylinder.

The wiping means and the sweeping means may take the form of parallel, spaced flexible blades of unequal length which form acute angles with the approaching surface of the printing plate. A separate catching blade may be provided which defines a recess for catching residue removed from the surface of the printing plate. Should the blades be moved too far into contact with the surface of the printing plate, the movement will be arrested by means of a pair of rollers which will contact and ride on the surface of the cylindrical barriers which cap the ends of the plate cylinder. The blades and the support are preferably elongated and extend across the entire width of the printing plate so as to clean the entire surface thereof when actuated. The blades may be slit to form blade segments which more accurately follow the surface of the printing plate. The material characteristics and dimensions of the blades are important to the proper operation of the invention.

The invention also encompasses a method of removing particles of foreign matter adhering to the surface of a printing plate mounted on a rotating plate cylinder of a rotary printing press, comprising the steps of contacting the surface of the printing plate with a wiping means to spread and thin the layer of ink on the surface and expose the particles, and subsequently contacting the wiped surface with a sweeping means to disturb and dislodge the exposed particles.

BRIEF DESCRIPTION OF THE DRAWINGS

The novel features of the invention are set out with particularity in the appended claims, but the invention will be understood more fully and clearly from the following detailed description of the invention as set forth in the accompanying drawings, in which:

DESCRIPTION OF THE INVENTION

Applicant has discovered that the effective removal of foreign particles from the surface of the printing plate involves a two-step procedure which the apparatus of the present invention is designed to implement. First, the thin film of ink adhering to the surface of the printing plate must be spread out and thinned in order to expose the particles embedded therein. Second, the exposed particles must then be disturbed and dislodged before they are again encapsulated by a thin film of ink. Although the prior art was aware that adhering particles were embedded in this film of ink, they failed to recognized that effective removal hinged upon the two-step process that applicant has discovered. Hence, the single-blade scrapers of the prior art devices are most ineffective in removing adhered particles, leaving them stuck to the surface of the printing plate to be further embedded in ink during the next inking cycle.

In the description that follows, the present invention will be described with reference to a planographic printing press having a rotary plate cylinder on which the printing plate is mounted. Presses of this type include lithographic and offset printing presses. Planographic presses are those in which the printing plate has a relatively flat, smooth surface. It is to be understood, however, that the invention can be adapted to printing presses of any type wherein the printing plate is moved during the printing cycle.

Figures 1, 2:
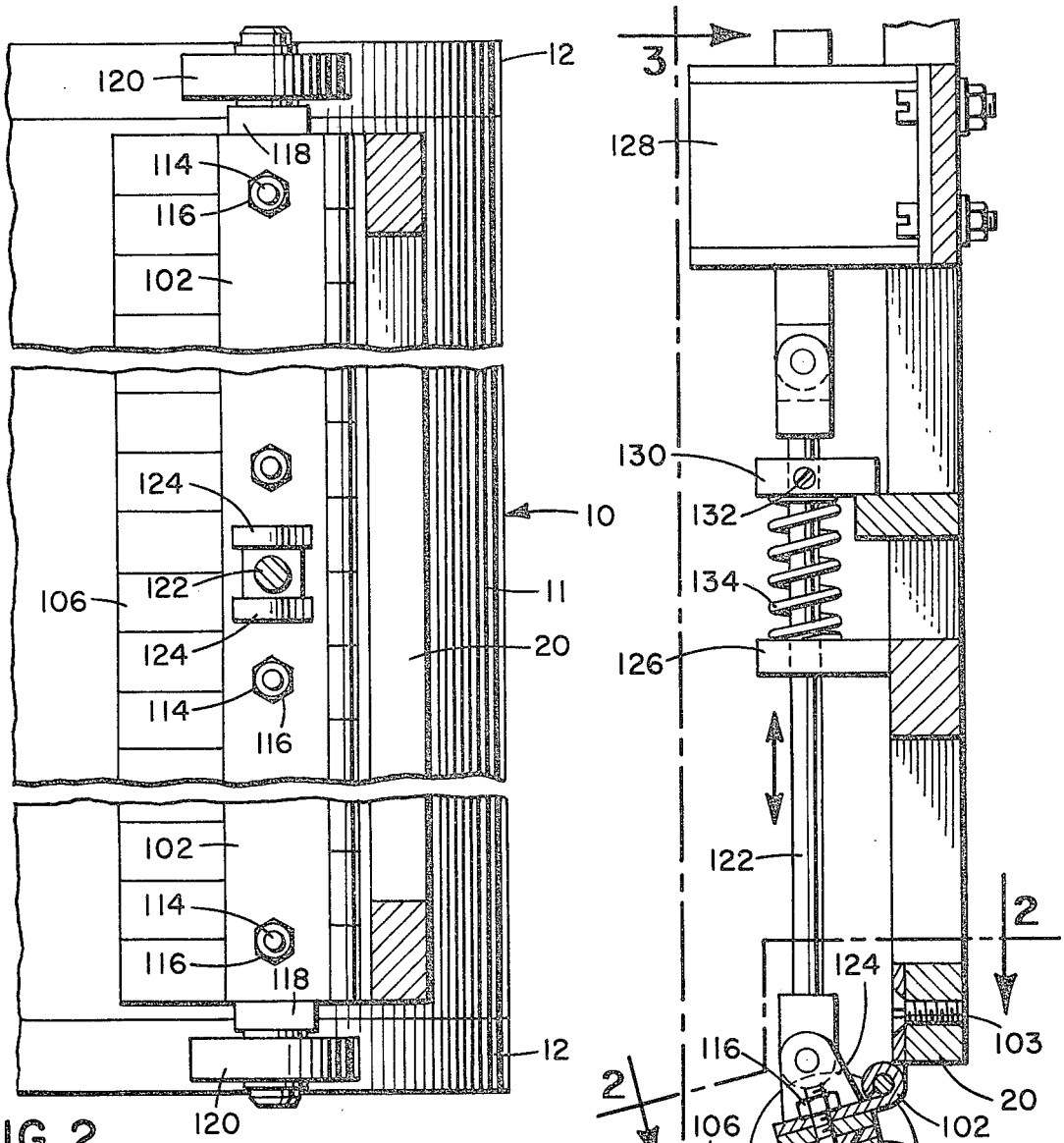
FIG. 1 is a side view, partly in section, of one form of the apparatus according to the invention.
FIG. 2 is a top plan view of the same, partly in section, taken along line 2—2 in FIG. 1.
Figure 3:
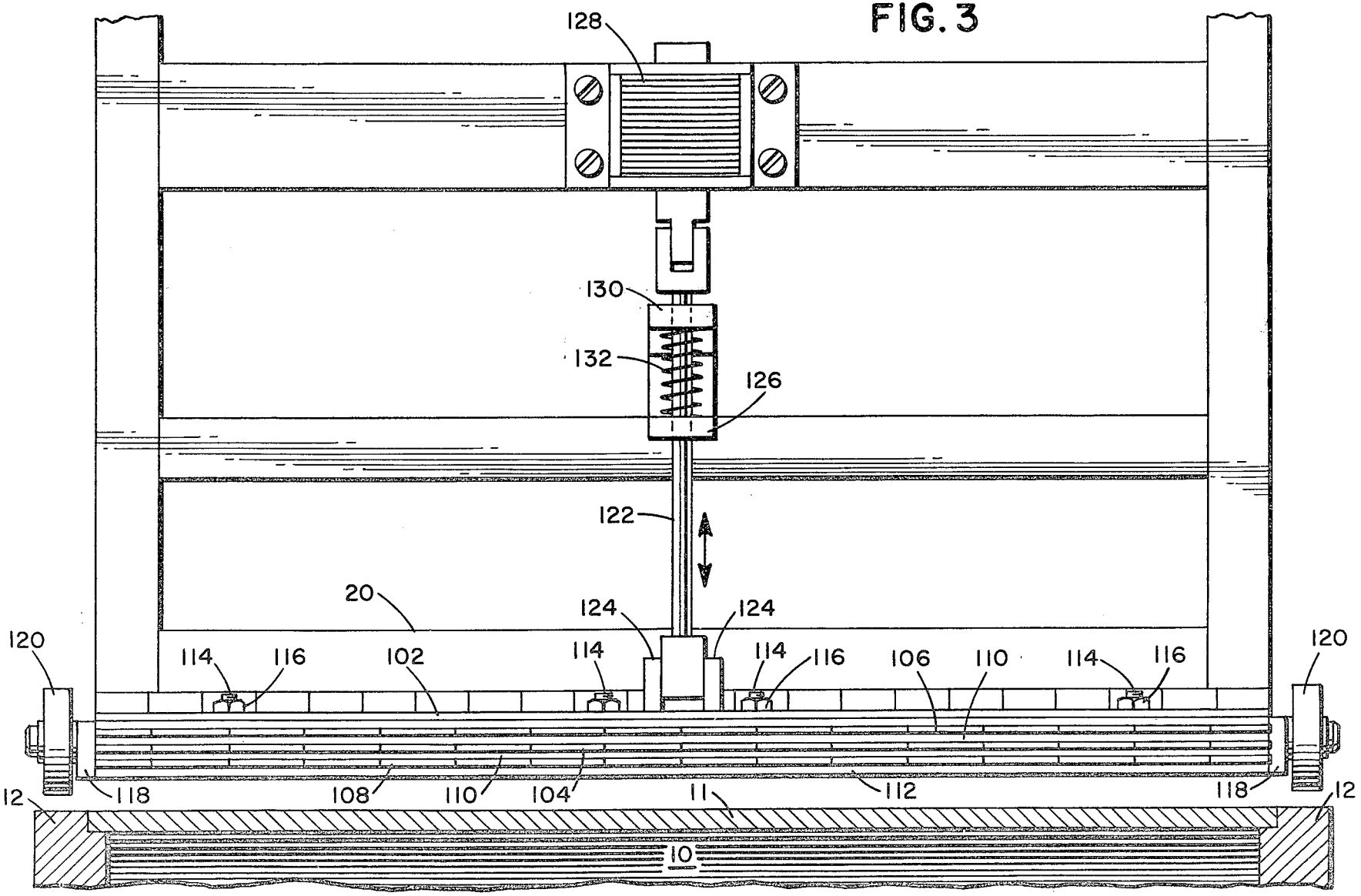
FIG. 3 is a front elevational view of the same taken along line 3—3 in FIG. 1.

Referring to the preferred embodiment shown in the Figures, and particularly to FIGS. 1, 2 and 3, the apparatus according to the present invention comprises a hinged mounting plate 102 which is secured by screws 103 or other appropriate means to a frame member 20 of a printing press. Member 20 may be an actual portion of the frame, or may comprise a suitable bracket mounted to the frame for the purpose of affording a convenient mounting location for the apparatus. This location is adjacent to the rotary plate cylinder 10 of the printing press. Plate cylinder 10 carries a printing plate 11 on its surface which receives a layer of ink from an inking mechanism (not shown) and transfers the inked image, through appropriate means, to the paper to be printed. For example, in offset printing presses, the inked impression from the printing plate is first made on a rubber-blanketed cylinder and then transferred to the paper being printed. Plate cylinder 10 is capped at each end by a cylindrical barrier 12, the barriers flanking printing plate 11.

Mounting member 102 is elongated and extends across substantially the entire width of the printing plate and generally parallel to the axis of plate cylinder 10. A wiping blade 104, a sweeping blade 106 and a catching blade 108 are sandwiched together with spacers 110 between mounting plate 102 and a clamping plate 12. These elements are all secured together by means of bolts or screws 114 and nuts 116 which pass through apertures in the clamping and mounting plates. Each blade is slit along its cantilevered portion to form individual cantilevered blade segments. A safety roller 120 is journalled for rotation at each end of the blade assembly to a suitable bracket 118, the safety rollers being in alignment with barriers 12 of plate cylinder 10.

In order to move the blade assembly into and out of contact with the surface of the printing plate, a reciprocating operating rod 122 is pivotally connected to plates 124, extends upwardly through guide 126 and is connected to an actuator, such as a solenoid 128. An adjustable stop 130 having a set screw 132 may be provided on rod 122. Stop 130 also functions as an abutment for a return spring 134 which biases the blade assembly away from the surface of the printing plate. Solenoid 128 may be remotely operated from the press inspection table, where freshly printing copies are examined for quality.

In operation, plate cylinder 10 rotates in the direction indicated by the arrow in FIG. 1. When the press operator detects an imperfection in the finished product at the press inspection table, solenoid 128 is remotely actuated to drive rod 122 downwardly, thereby pivoting mounting plate 102 about its hinge axis and pressing blades 104 and 106 into engagement with the surface of the printing plate 11 at approximately the same time. The apparatus is so located that the blades will contact the printing plate at a point in its rotation after the ink image has been transferred, but before the plate is inked again. A thin remaining film of ink will be present on the surface of the printing plate and will cover and encapsulate any foreign particles adhering thereto. Wiping blade 104 is encountered first by the particles. This blade acts to spread and thin the film of ink on the surface and expose the adhering particles. The exposed particles then encounter sweeping blade 106 which disturbs and dislodges them from the surface of printing plate 11. The action of sweeping blade 106 may be likened to a "flicking" of the particles off the surface. The cooperation of the wiping and sweeping blades effectively removes any particles of foreign matter adhering to the surface of the printing plate. The segments of the slit blades more closely follow the contour of the surface of the printing plate than a single elongated blade. Catching plate 108 does not contact the surface of the printing plate but is spaced very closely thereto. Catching blade 108 and wiping blade 104 together define a recess 140 which catches and retains residue wiped from the surface of the printing plate by wiping blade 104. Hence, the residue is prevented from spreading elsewhere throughout the printing press mechanism.

In the event that stop 130 should be incorrectly set or slip from its present position, the blade assembly is kept from moving too far into contact with the printing plate and possibly causing damage by means of safety rollers 120. These are positioned and dimensioned to limit the movement of the blade assembly toward the plate cylinder by riding on the cylindrical barriers 12.

The effective operation of the apparatus according to the invention is dependent upon the proper selection of material for blades 104 and 106, and proper selection of their thickness and length. These selections are dictated by the functional considerations of the apparatus. Thus, the material must be softer than the material of which the printing plate is made so as not to scrape or abrade its delicate surface. However, the material must not be so soft as to have a very short service life. Blade flexibility is another important factor. Wiping blade 104 must be flexible enough to yield when it contacts the surface of the printing plate, yet rigid enough to thin and spread the film of ink on the surface. Sweeping blade 106 must have the proper flexibility to enable it to deflect on contact but be rigid enough to disturb and dislodge or flick the adhering particles from the surface. Both of these blades must not be too brittle in order to prevent breakage. They must be made of a material which is resistant to the solvents conventionally used in printing presses.

With these considerations in mind, one suitable material for accomplishing these objectives is a film-forming polyester such as MYLAR (a registered trademark of E. I. du Pont de Nemours and Company) which is extruded into the proper shape and thickness for each blade. Blades formed of polytetrafluoroethylene, such as TEFLON (a registered trademark of du Pont) would also be suitable. A sweeping blade 106 formed of MYLAR would typically be $\frac{1}{8}$ inch thick and have a cantilever portion two inches high. The blade would be slit into segments $\frac{1}{2}$ inch in width. Wiping blade 104 would typically be 1/16 inch thick and have a height of $1\frac{3}{4}$ inches. Catching blade 108 would typically be 1/6 inch thick and $1\frac{1}{4}$ inches in height. The spacers between the blades would be $\frac{1}{8}$ inch thick and $\frac{3}{4}$ inches in height. The angle of the blades with respect to the surface of the printing plate is also important for the proper operation of the apparatus. The blades must be positioned approximately as illustrated in FIG. 1, with the blades forming an acute angle with the advancing surface of the printing plate.

Figure 4:
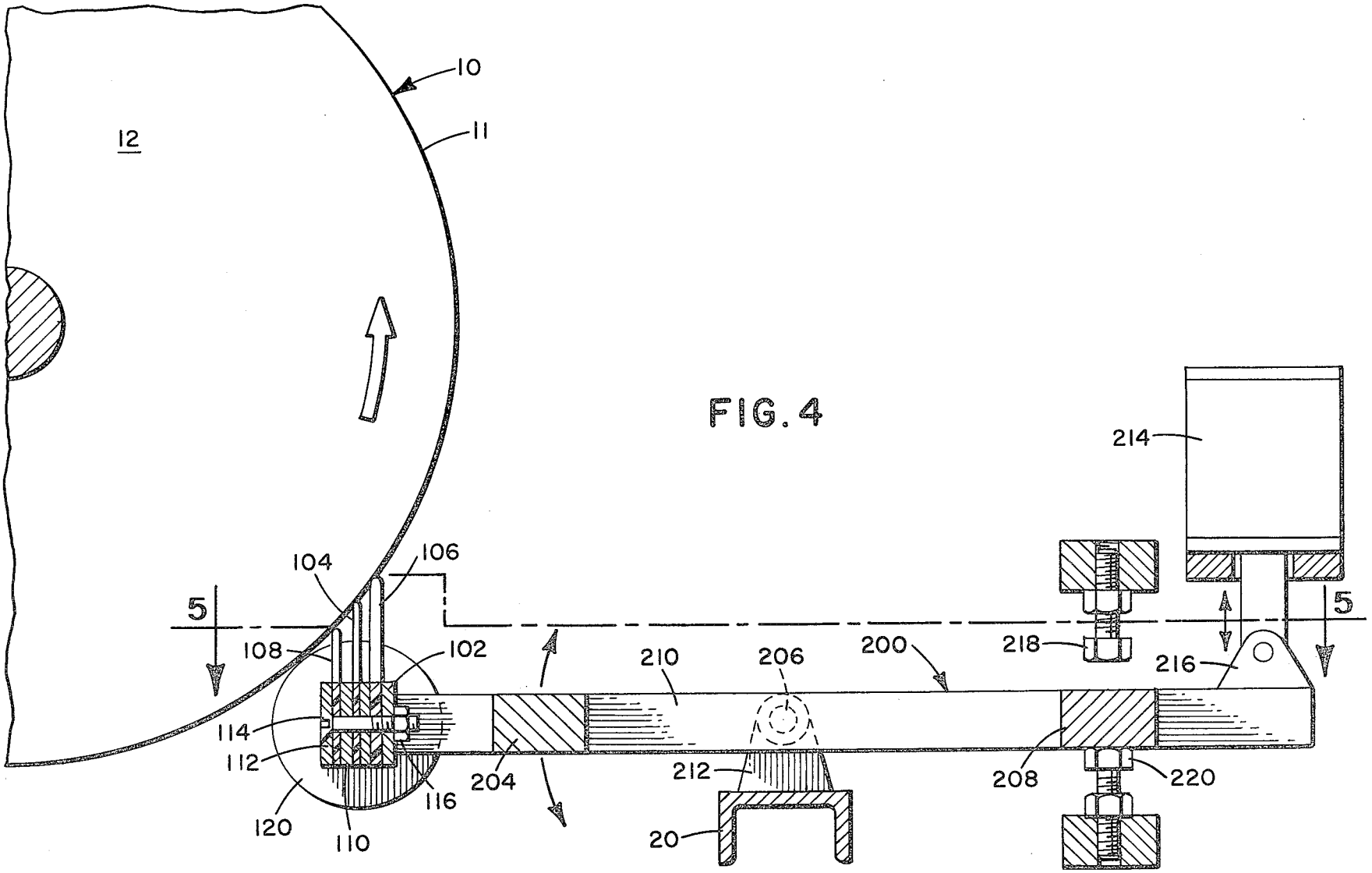
FIG. 4 is a side elevational view of another form of the apparatus according to the invention.
Figure 5:
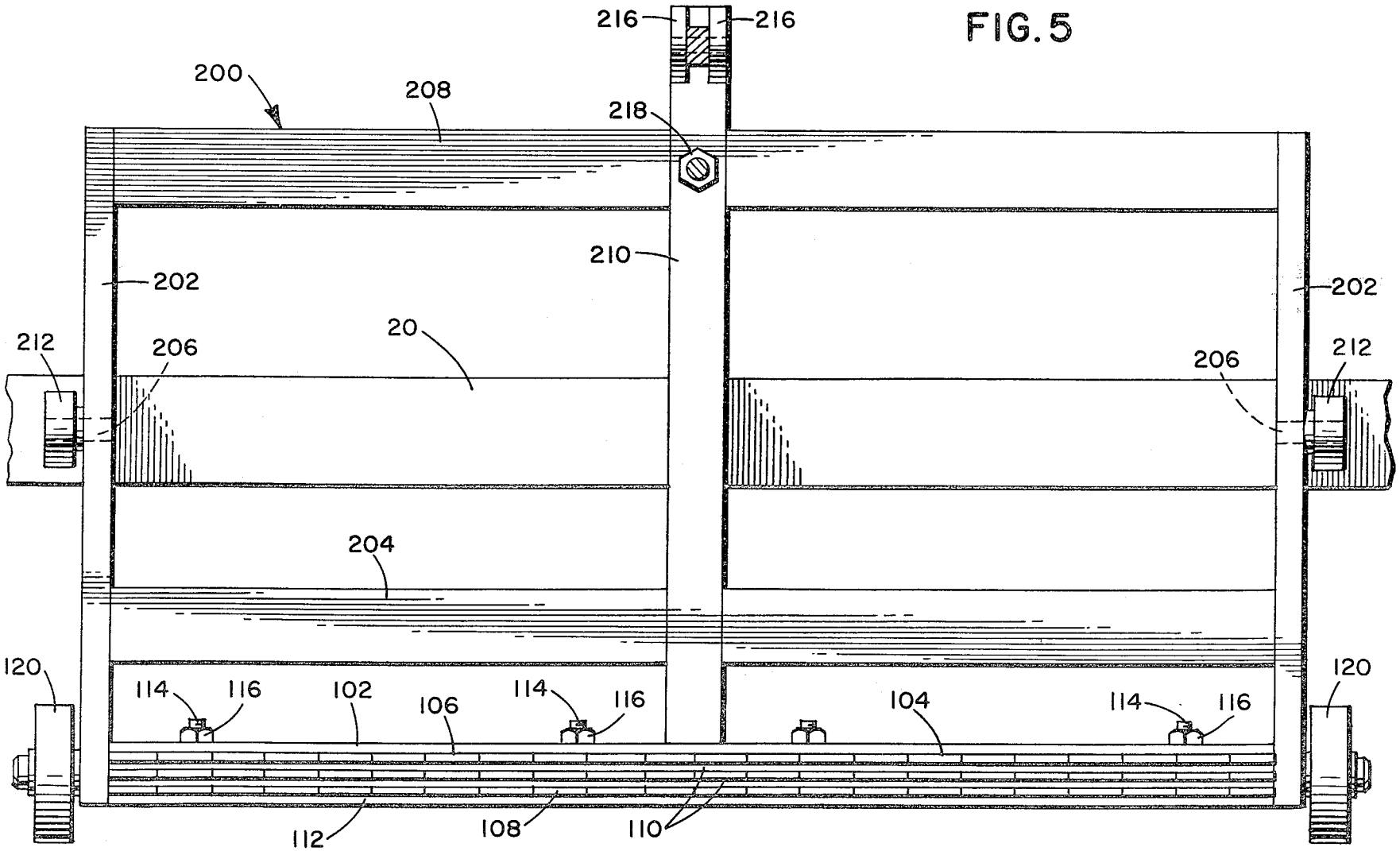
FIG. 5 is a top plan view of the same taken along line 5—5 in FIG. 4.

An alternative form of the apparatus according to the invention is illustrated in FIGS. 4 and 5. In this embodiment, like numerals indicate parts which are similar to those in the embodiment of FIGS. 1, 2 and 3. The blade assembly is mounted at the end of an elongated carriage 200 which comprises side rails 202, cross members 204 and 208, and center rail 210. The carriage is pivoted to a portion 20 of the press frame through side rails 202 by pivot pins 206 supported in journals 212. A solenoid actuator 214 is connected to the remote end of the carriage by means of plates 216. Adjustable limit stops 218 and 220 act on central member 210 to limit the pivotal movement of the carriage about journals 212. The blade assembly will be biased away from the surface of the printing plate by means of gravity. The operation of this form of the invention is substantially similar to that of the embodiment of FIGS. 1, 2 and 3.

It will be obvious to one of ordinary skill that numerous modifications may be made without departing from the true spirit and scope of the invention which is to be limited only by the appended claims.

I claim:

1. Apparatus for quickly removing particles of foreign matter adhering to the surface of an image-bearing printing plate mounted on the periphery of a rotating plate cylinder of a rotary printing press while the press is operating, said apparatus comprising:

a support member;

a flexible, cantilevered wiping blade rigidly affixed to said support member;

a separate flexible, cantilevered sweeping blade rigidly affixed to said support member adjacent to said wiping blade and immediately therebehind in relation to the direction of movement of said printing plate surface, said sweeping blade extending from said support a greater distance than said wiping blade; and operating means connected to said support member for selectively moving said blades into and out of contact with the surface of said printing plate during rotation of the plate cylinder, said blades extending away from said printing plate at acute angles with the advancing surface of said printing plate when said blades are in contact with said surface, whereby said wiping blade wipes said printing plate surface to spread and thin ink on said surface and expose said particles, and said sweeping blade immediately sweeps the surface wiped by said wiping blade to disturb and dislodge the exposed particles.

2. Apparatus according to claim 1 further comprising a catching blade carried by said support member adjacent to and spaced from said wiping blade to define a recess for catching residue wiped from the surface of said printing plate.

3. Apparatus according to claim 1 wherein said support, said wiping blade and said sweeping blade are elongated and extend across substantially the entire width of said printing plate and generally parallel to the axis of said plate cylinder to wipe and sweep substantially the entire surface of said printing plate.

4. Apparatus according to claim 3 wherein said blades are slit to form a plurality of cantilevered blade segments of narrower width.

5. Apparatus according to claim 4 wherein said blade segments extend from said support a distance greater than their width.

6. Apparatus according to claim 1 or 4 wherein said blades are made of a flexible material which is softer than the material of which said printing plate is made so as not to abrade the surface of said printing plate.

7. Apparatus according to claim 6 wherein said material is chosen from the class of materials consisting of a film-forming polyester and polytetrafluoroethylene.

8. Apparatus according to claim 1 wherein said support member is hingedly connected to the frame of said press along a line generally parallel to the axis of said plate cylinder, said operating means comprising reciprocating actuating means operatively connected to said mounting plate for oscillating said plate about said hinge line.

9. Apparatus according to claim 1 wherein said operating means comprises an elongated carriage which extends away from said plate cylinder and is pivotally connected to the frame of said press along a line generally parallel to the axis of said plate cylinder, said support member being secured to said carriage close to said plate cylinder.

10. In a rotary printing press having a rotating plate cylinder carrying an image-bearing printing plate on its periphery, inking means for periodically applying a film of ink to the surface of said printing plate to ink the image thereon, and transfer means for periodically transferring a layer of said film of ink covering said image from said printing plate to paper whereby an ink image appears on the paper and a portion of said film of ink remains on the surface of said printing plate, apparatus for quickly removing particles of foreign matter from the surface of said printing plate, while the press is operating, after the inked image is transferred therefrom by said transfer means and before the surface of said printing plate is reinked by said inking means, said apparatus comprising:

a movable support mounted adjacent to said plate cylinder and the surface of said printing plate thereon;

wiping means comprising a cantilevered flexible blade carried by said support for wiping the surface of said printing plate to spread and thin the ink remaining on said surface after image transfer and expose said particles;

separate sweeping means comprising a cantilevered flexible blade carried by said support adjacent and parallel to said wiping blade for immediately sweeping the surface wiped by said wiping blade to disturb and dislodge said exposed particles;

a catching blade carried by said support generally parallel to and spaced from said wiping blade opposite said sweeping blade, said catching blade being dimensioned such that it does not contact said printing plate and defines a recess with said wiping blade for catching residue wiped from the surface of said printing plate; and operating means connected to said support for selectively moving said wiping blade and said sweeping blade into and out of contact with the surface of said printing plate during rotation of said plate cylinder.

11. In a rotary printing press having a rotating plate cylinder carrying an image-bearing printing plate on its periphery, inking means for periodically applying a film of ink to the surface of said printing plate to ink the image thereon, and transfer means for periodically transferring a layer of said film of ink covering said image from said printing plate to paper whereby an ink image appears on the paper and a portion of said film of ink remains on the surface of said printing plate, apparatus for quickly removing particles of foreign matter from the surface of said printing plate, while the press is operating, after the inked image is transferred therefrom by said transfer means and before the surface of said printing plate is reinked by said inking means, said apparatus comprising:

a movable support mounted adjacent to said plate cylinder and the surface of said printing plate thereon;

wiping means comprising a cantilevered flexible blade carried by said support for wiping the surface of said printing plate to spread and thin the ink remaining on said surface after image transfer and expose said particles;

separate sweeping means comprising a cantilevered flexible blade carried by said support adjacent and parallel to said wiping blade for immediately sweeping the surface wiped by said wiping blade to disturb and dislodge said exposed particles; and operating means connected to said support for selectively moving said wiping means and said sweeping means into and out of contact with the surface of said printing plate during rotation of said plate cylinder;

wherein said wiping blade extends a lesser distance from said support than said sweeping blade, said support being mounted relative to said plate cylinder such that the tips of said blades contact said printing plate at approximately the same time when said operating means is actuated, and said blades extend away from said printing plate at acute angles with the advancing surface of said printing plate.

* * * * *